US008481986B2

(12) United States Patent
Kibata et al.

(10) Patent No.: US 8,481,986 B2
(45) Date of Patent: Jul. 9, 2013

(54) NEUTRON SHIELDING MATERIAL, METHOD OF MANUFACTURING THE SAME, AND CASK FOR SPENT FUEL

(75) Inventors: Masanori Kibata, Yokohama (JP); Yuuji Saito, Yokohama (JP); Motoji Tsubota, Fujisawa (JP); Yoshitaka Doken, Yokohama (JP); Makoto Sato, Tokyo (JP); Shunichi Hatano, Yokosuka (JP); Masanori Ishiga, Yokohama (JP); Go Ono, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/360,213

(22) Filed: Jan. 27, 2012

(65) Prior Publication Data

US 2012/0187315 A1 Jul. 26, 2012

Related U.S. Application Data

(63) Continuation of application No. PCT/JP2010/004794, filed on Jul. 28, 2010.

(30) Foreign Application Priority Data

Jul. 28, 2009 (JP) ..... P2009-175778

(51) Int. Cl.
*G21F 5/008* (2006.01)
*C22C 38/32* (2006.01)
*B21B 3/02* (2006.01)

(52) U.S. Cl.
USPC ..... 250/506.1; 250/505.1; 148/24; 148/26

(58) Field of Classification Search
USPC ..... 250/505.1, 506.1; 148/24, 26
See application file for complete search history.

(56) References Cited

U.S. PATENT DOCUMENTS

| | | | | |
|---|---|---|---|---|
| 3,854,938 | A * | 12/1974 | Baybrook et al. | 420/46 |
| 4,341,555 | A * | 7/1982 | Douthett et al. | 420/42 |
| 4,521,691 | A * | 6/1985 | Christ et al. | 250/506.1 |
| 5,820,818 | A | 10/1998 | Kajimura | |
| 7,170,073 | B2 * | 1/2007 | Ishida et al. | 250/518.1 |
| 2012/0187315 | A1 * | 7/2012 | Kibata et al. | 250/506.1 |

FOREIGN PATENT DOCUMENTS

| | | |
|---|---|---|
| CA | 2 229 002 | 6/2001 |
| CA | 2 498 585 | 3/2004 |

(Continued)

OTHER PUBLICATIONS

International Search Report from Japanese Patent Office for International Application No. PCT/JP2010/004794, Mailed Oct. 26, 2010.

(Continued)

*Primary Examiner* — David A Vanore
(74) *Attorney, Agent, or Firm* — Finnegan, Henderson, Farabow, Garrett & Dunner, L.L.P.

(57) ABSTRACT

In one embodiment, a neutron shielding material is formed of boron-adding stainless steel of either austenite-ferrite two-phase stainless steel or ferritic stainless steel, the austenite-ferrite two-phase stainless steel containing, in mass %, B: 0.5% to 2.0%, Ni: 3.0 to 10.0%, and Cr: 21.00 to 32.00%, the ferritic stainless steel containing, in mass %, B: 0.5% to 2.0%, Ni: 4.0% or less, and Cr: 11.00 to 32.00%, and the boron-adding stainless steel being well in ductility and thermal conduction property.

5 Claims, 7 Drawing Sheets

FOREIGN PATENT DOCUMENTS

| | | |
|---|---|---|
| CN | 1681955 | 10/2005 |
| EP | 0 844 312 | 5/1998 |
| EP | 1 548 140 | 6/2005 |
| JP | 55-89459 | 7/1980 |
| JP | 5-7455 | 1/1993 |
| JP | 6-207207 | 7/1994 |
| JP | 9-49066 | 2/1997 |
| JP | 10-219399 | 8/1998 |
| JP | 11-158583 | 6/1999 |
| JP | 2004-156132 | 6/2004 |
| JP | 2006-53014 | 2/2006 |
| JP | 2007-118025 | 5/2007 |
| JP | 2008-281437 | 11/2008 |
| KR | 1999-028428 | 4/1999 |
| TW | 200407438 | 9/2003 |
| WO | WO 97/06286 | 2/1997 |
| WO | WO 2004/024969 | 3/2004 |

OTHER PUBLICATIONS

JIS G 0567, "Method of elevated temperature tensile test for steels and heat-resisting alloys," Japanese Industrial Standard, Reference No. JIS G 0567 : 1998 (E), 9 Sheets.

English-language abstract of Korean patent publication No. 1020050046752 published May 18, 2005.

Notification of Transmittal of Translation of the International Preliminary Report on Patentability for International Application No. PCT/JP2010/004794, mailed Feb. 16, 2012.

Written Opinion of the International Search Authority related to International Application No. PCT/JP2010/004794; mailed Oct. 26, 2010, for Kabushiki Kaisha Toshiba.

Notice of Reasons for Rejection issued by the Japanese Patent Office on Jul. 31, 2012, for Japanese Patent Application No. 2009-175778, and English-language translation thereof.

* cited by examiner

NEUTRON SHIELDING MATERIAL, METHOD OF MANUFACTURING THE SAME, AND CASK FOR SPENT FUEL

CROSS-REFERENCE TO RELATED APPLICATIONS

This application is a continuation of prior International Application No. PCT/JP2010/004794 filed on Jul. 28, 2010 which is based upon and claims the benefit of priority from Japanese Patent Application No. 2009-175778, filed on Jul. 28, 2009; the entire contents of all of which are incorporated herein by reference.

FIELD

Embodiments described herein relate generally to a neutron shielding material using an alloy containing boron (B), a method of manufacturing the same, and a cask being a dedicated container using the neutron shielding material and used for storage and transport of a highly radioactive material.

BACKGROUND

In a nuclear power plant, spent fuel taken out of a reactor core after operation of a nuclear rector for a fixed period of time is housed and stored in a spent fuel storage rack placed in a spent fuel storage pool in the power plant until reprocessing of the spent fuel is performed, and thereby the spent fuel is cooled and decay heat removal is performed.

In recent years, housing capacity of the storage pool has been tight, so that space in the storage pool has been utilized effectively to increase storing capacity of the storage pool. Further, there has been a plan to build an interim storage facility outside the power plant as a large-sized spent fuel storage facility to store fuel therein. As a container for transporting the spent fuel to an interim storage facility from the power plant, a cask has been used. It is a lattice-shaped basket that is used when the fuel is housed in the above cask. In the above basket, there is used a neutron shielding material made of an alloy to which boron having neutron shielding capability is added and that is based on austenitic stainless steel being the same as that of the spent fuel rack used in water of the pool in the power plant.

As for the boron-containing austenitic stainless steel, a technique described below has been known. That is, the B-containing austenitic stainless steel is obtained in a manner that 500 μm or less of nitrogen-gas atomized powder containing B, C, Si, Cr, Ni, Mo, N, and O falling within a specific range is filled in a specific mild steel can, and the can is vacuum sealed, and then the nitrogen-gas atomized powder is subjected to a HIP treatment under specific temperature and pressure conditions.

The boron-containing austenitic stainless steel has been used for a nuclear fuel transport container, a spent nuclear fuel storage rack, and the like as a control rod and a shielding material by using neutron absorption capability that boron has.

Conventionally, there has been used a shielding plate based on austenitic stainless steel containing about 1% or more of boron for nuclear reactor control and for neutron shielding. In order to provide the neutron absorption capability to the shielding plate, the more an added amount of boron becomes, the better it is, but a solid solution amount of boron into the austenitic stainless steel is quite small, and most of added boron bonds to chromium to precipitate as boride. Thus, a chromium amount in a parent material is reduced to thereby reduce mechanical strength, ductility, and the like of the shielding plate. Further, as an added amount of boron is increased, this reduction tendency becomes noticeable.

A boron-adding alloy has been originally used for a rack of a fuel housing member of a fuel storage pool provided in a power plant. The rack only needs a certain degree of material property because the rack itself is not aimed at moving, but the rack has been manufactured based on austenitic stainless steel with the emphasis on its service life and safety because of being used in water. However, when the rack is targeted at a spent fuel storage container (cask) for transport, or the like, there is room to consider dropping and impact at the time of transport, and thus it is necessary to further increase a mechanical property of the rack. Further, a dry storage cask based on austenitic stainless steel that is a conventional material has a low thermal conduction property to thus cause a problem that cooling efficiency has to be further improved.

DETAILED DESCRIPTION

Figure 1:
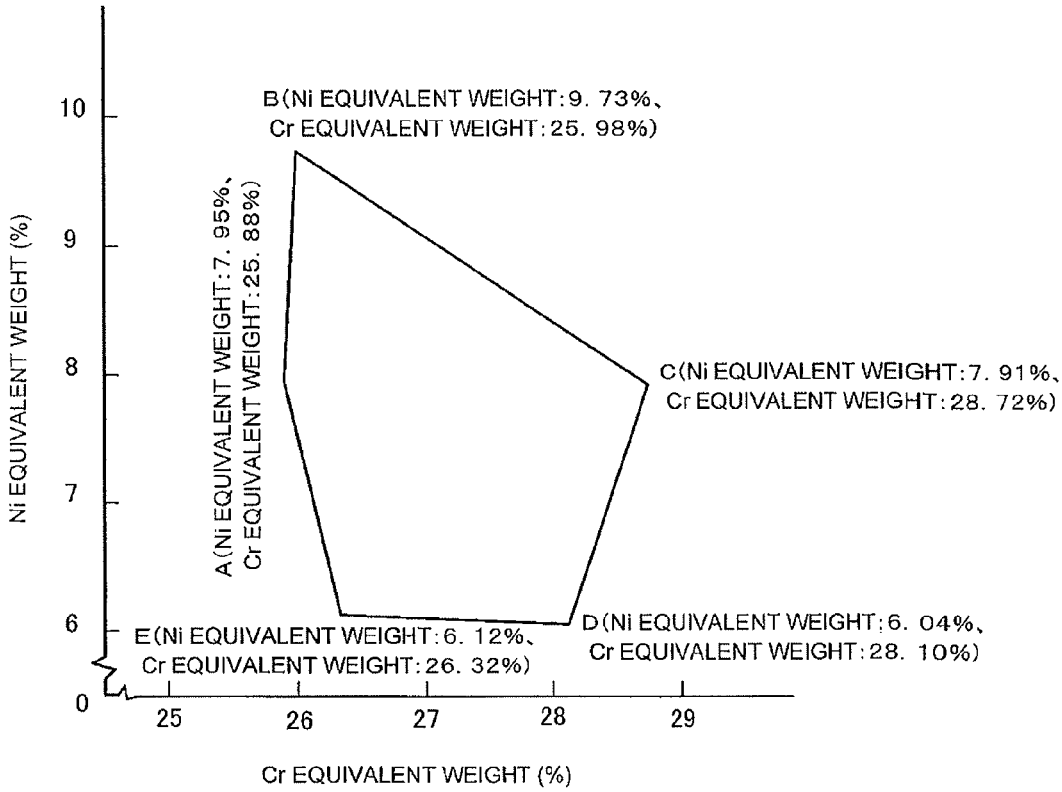
FIG. 1 is a graph showing a relationship between Ni equivalent weight and Cr equivalent weight in an embodiment.

In one embodiment, a neutron shielding material made of boron-adding stainless steel of either austenite-ferrite two-phase stainless steel or ferritic stainless steel, the austenite-ferrite two-phase stainless steel containing, in mass %, B: 0.5% to 2.0%, Ni: 3.0 to 10.0%, and Cr: 21.00 to 32.00%, the ferritic stainless steel containing, in mass %, B: 0.5% to 2.0%, Ni: 4.0% or less, and Cr: 11.00 to 32.00%, and the boron-adding stainless steel being well in ductility and thermal conduction property.

Hereinafter, a neutron shielding material in embodiments, a method of manufacturing the same, and an embodiment of a cask for transportingorstoringspent fuel (transport and storage dual purpose cask) will be explained. Note that in the following explanation, % representing contents of chemical components refers to mass % unless otherwise mentioned.

A boron-adding alloy based on either austenite-ferrite two-phase (that will be sometimes abbreviated to "two-phase" hereinafter) stainless steel or ferritic stainless steel (that is a parent material) is made in order to improve a mechanical property and a thermal conduction property of a conventional material. Incidentally, in the two-phase stainless steel composed of two phases of a ferrite phase and an austenite phase, a ferrite phase ratio indicating a ratio of the ferrite phase to all the phases generally falls within a range of 7 to 98%, and preferably, it is desirable that the ferrite phase ratio falls within a range of 10 to 85%. Thereby, in an embodiment material having a low Ni content ratio, it is possible to improve its thermal conduction property and to achieve reduction in material cost.

However, it was found that in two-phase based and ferrite-based materials each having ductility originally lower than that of an austenite-based conventional material, in order to improve the low ductility, content ratios of inevitable impurities in a base alloy only have to be defined. Concretely, P is preferably set to 0.010% or less, S is preferably set to 0.002% or less, Al is preferably set to 0.05% or less, O is preferably set to 0.008% or less, and N is preferably set to 0.005% or less.

Next, reasons for limiting content ranges of chemical components being the inevitable impurities contained in the neutron shielding material will be explained.

(1) P (Phosphorus): 0.010% or Less

P is an element that produces low melting chemical compounds, and is required to be reduced as much as possible. Thus, when P is set to 0.010% or less, an effect of obtaining the neutron shielding material excellent in ductility is obtained thereby.

(2) S (Sulfur): 0.002% or Less

Similarly to P, S is also an element that produces low melting chemical compounds, and is required to be reduced as much as possible. Thus, when S is set to 0.002% or less, an effect of obtaining the neutron shielding material excellent in ductility is obtained thereby.

(3) Al (Aluminum): 0.05% or Less

A very small amount of Al is desirably added as a deoxidizer, and 0.05% or less of Al makes it possible to suppress the production of low melting chemical compounds and to achieve improvement of the ductility.

(4) O (Oxygen): 0.008% or Less

O is desirably 0.008% or less because it is possible to improve the ductility of the neutron shielding materials that are based on the two-phase stainless steel and ferritic stainless steel and to which boron in an amount sufficient to absorb neutrons is added.

(5) N (Nitrogen): 0.005% or Less

When N exceeds 0.005%, the ductility of the neutron shielding material tends to decrease, and thus N is desirably 0.005 or less.

Next, a boron content ratio of boron-adding stainless steel is preferably set to fall within a range of 0.5 to 2.0%. In the case when boron is less than 0.5%, the ductility tends to improve, but an effect of shielding neutrons is reduced, resulting in that boron being less than 0.5% becomes unsuitable for a basket material. On the other hand, when boron exceeds 2.0%, the ductility decreases noticeably to further make a basket become vulnerable to drop impact, and thus boron is not defined to be greater than 2.0% in this embodiment. In the boron-adding stainless steel based on either the two-phase stainless steel or the ferritic stainless steel in this embodiment, it is suitable that the boron amount is 0.5 to 2.0%.

Amounts of C, Si, Mn, and Mo of either the two-phase stainless steel or the ferritic stainless steel are preferably set to C: 0.030% or less, Si: 1.00% or less, Mn: 1.50% or less, and Mo: 3.50% or less. According to this embodiment, content ratios of C, Si, Mn, and Mo are adjusted to the predetermined amounts, and thereby the boron-adding stainless steel excellent in ductility is obtained.

In the boron-adding stainless steel based on the two-phase stainless steel, content ratios of Ni and Cr that are main chemical components are Ni: 3.0 to 10.0% and Cr: 21.00 to 32.00%. This embodiment based on the above two-phase stainless steel contains less Ni than conventional steel, and is excellent in thermal conduction property.

In the boron-adding stainless steel based on the ferritic stainless steel, content ratios of Ni and Cr that are main chemical components are Ni: 4.0% or less, which is preferably less than 3.0%, and Cr: 11.00 to 32.00%. The boron-adding stainless steel based on the ferritic stainless steel is more excellent in thermal property in particular, than conventional one based on austenitic stainless steel, can efficiently cool spent fuel, and is more suitable than conventional steel. Further, the above-described boron-adding stainless steel in which the content ratios of the inevitable impurities are defined can be manufactured by a method similar to that of the boron-adding stainless steel based on the two-phase stainless steel.

Further, FIG. 1 is a view showing a range of components of the embodiment material shown on the drawing according to the Schaeffler diagram. In FIG. 1, the horizontal axis indicates Cr equivalent weight (%) expressed by % Cr+% Mo+1.5×% Si, and on the other hand, the vertical axis indicates Ni equivalent weight (%) expressed by % Ni+30×% C+0.5×% Mn. The two-phase stainless steel used in the embodiment according to the embodiment contains Cr, Mo, Si, Ni, C, and Mn falling within a range surrounded by a straight line passing through a point A (Ni equivalent weight: 7.95%, Cr equivalent weight: 25.88%), a point B (Ni equivalent weight: 9.73%, Cr equivalent weight: 25.98%), a point C (Ni equivalent weight: 7.91%, Cr equivalent weight: 28.72%), a point D (Ni equivalent weight: 6.04%, Cr equivalent weight: 28.10%), and a point E (Ni equivalent weight: 6.12%, Cr equivalent weight: 26.32%) that are shown in FIG. 1, and the remainder is composed of Fe and as the inevitable impurities, in mass %, P: 0.010% or less, S: 0.002% or less, Al: 0.05% or less, O: 0.008% or less, and N: 0.005% or less. Here, the point A is derived from an embodiment material 2, the point B is derived f rom an embodiment material 3, the point C is derived from an embodiment material 6, the point D is derived from an embodiment material 7, and the point E is derived from an embodiment material 5. The two-phase stainless steel is controlled to fall within the above-described specific range, and thereby the boron-adding stainless steel excellent in ductility and thermal conduction property can be manufactured.

Figure 2:
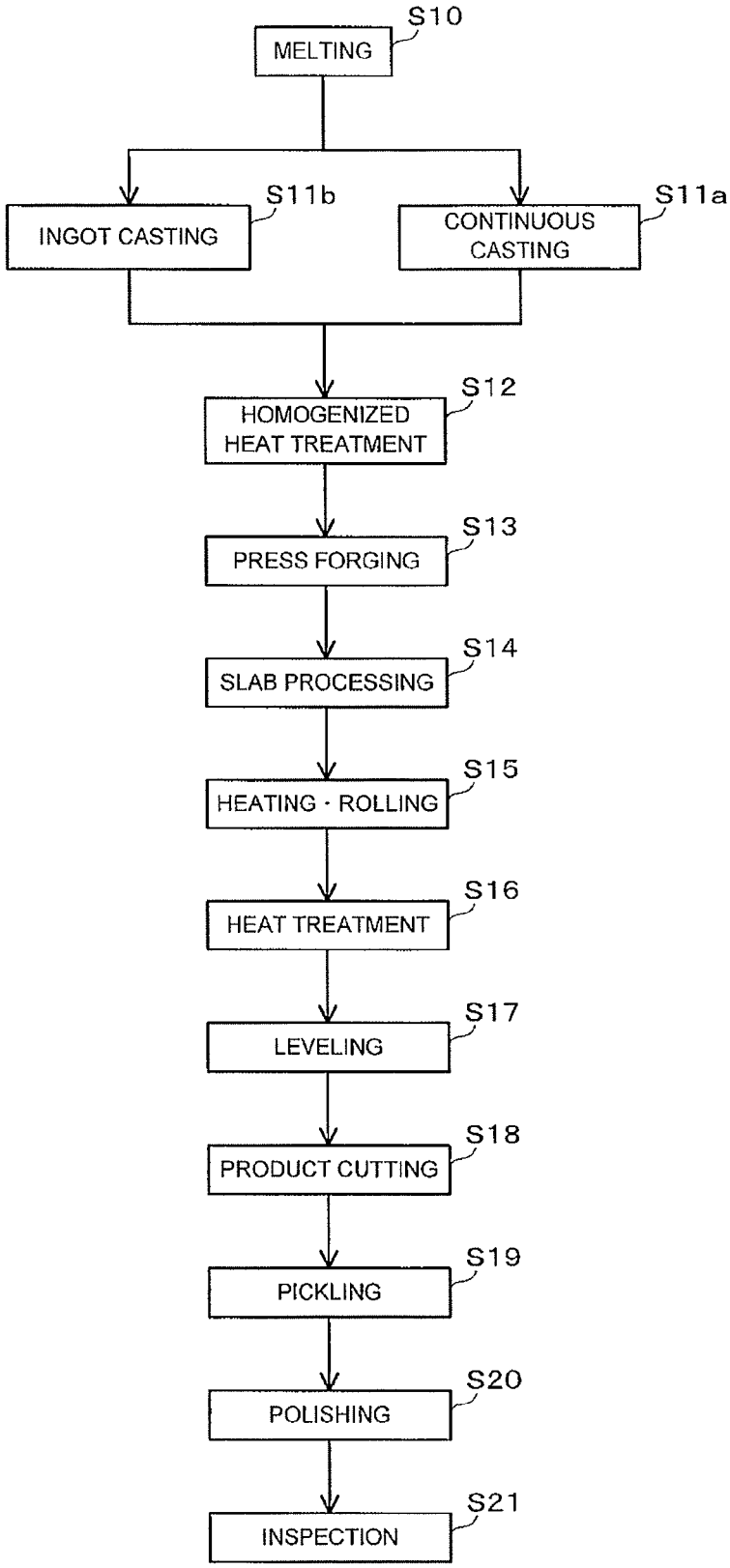
FIG. 2 is a process chart showing a method of manufacturing a basket material in an embodiment.

There are shown manufacturing processes of the neutron shielding material (basket material) made of the boron-adding stainless steel that is based on either the two-phase stainless steel or the ferritic stainless steel and is excellent in ductility and thermal conduction property in FIG. 2.

First, an alloy made of carbon, silicon, manganese, nickel, chromium, boron, and iron, and iron were set to be a melting raw material, and in the case of aluminum being used as an deoxidizer, boron was added in an alloy form with iron, and the melting raw material was melted (Step S10). At a steel tapping temperature of about 1500° C., a melted alloy was cast into an ingot case (Step S11*b*). It is also possible to perform continuous casting according to need (Step S11*a*). Here, a homogenized heat treatment of an ingot was performed in a range of 1050 to 1350° C. (Step S12). By performing the above homogenized heat treatment, the neutron shielding material made of the above-described boron-adding stainless steel excellent in ductility and thermal conduction property is obtained. Next, immediately before hot forging, the ingot was heated to about 1100° C., and was subjected to hot (press) forging in a range of about 900° C. to about 1200° C. to be finished into a slab having a thickness in a range of 50 to 30 mm (Step S13). After the forging, a cutting process was performed on a portion and an end portion corresponding to feeding heads of the ingot in order to roll the slab (Step S14). Next, in hot rolling, in a range of about 900° C. to about 1200° C., five to six (rolling passes) were performed, (which was set to a pass schedule), and thereby the slab was rolled to a thickness of about 5 mm or so from a thickness of about 30 mm (Step S15). After the rolling, the slab was subjected to a heat treatment in a range of 1000 to 1200° C. (Step S16), and was subjected to a surface treatment to be finished to a size of 1500 in width×4000 in length×, for example, 5 mm in predetermined thickness (Step S17). Thereafter, processes of product cutting (Step S18), pickling (Step S19), polishing (Step S20), and inspection (Step S21) were performed.

According to the above manufacturing method, the neutron shielding material in this embodiment can be manufactured under conditions similar to those of the conventional material, and an investment for additional manufacturing facilities and the like are not needed. Vickers hardness of the boron-adding stainless steel obtained by the above manufacturing method was measured and a homogeneous state of the material was confirmed.

It is possible that the neutron shielding material made of the boron-adding alloy based on either the two-phase stainless steel or the ferritic stainless steel in this embodiment is used and lattice frames and lattice plates are combined to form a basket shape to be provided as the cask basket material for transporting or storing spent fuel. Further, the neutron shielding material in this embodiment can also be used for a basket material for a canister, a rack material, or the like.

Next, embodiments of the metal cask for transporting or storing spent fuel in which the neutron shielding material is used will be explained with reference to the drawing and numerals added to the drawing.

Figure 3:
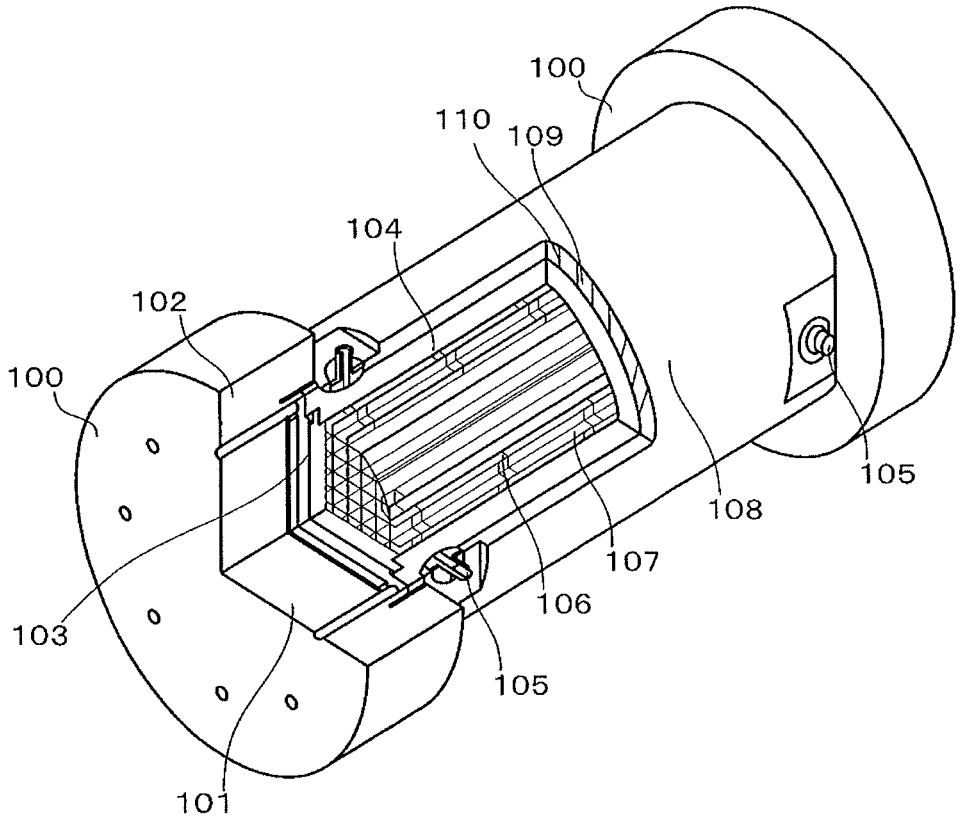
FIG. 3 is a perspective view of a cask in an embodiment.

FIG. 3 is a perspective view showing the metal cask that uses the neutron shielding material in this embodiment and is equipped with cask cushioning bodies and of which part is cut off. In FIG. 3, in a cylindrical container 104, a lattice-shaped basket 107 using the neutron shielding material is housed, and each spent fuel 106 is housed in spaces of the lattice of the basket 107, and further a top portion (left portion in FIG. 3) of the container 104 is sealed by a lid 103. Around the circumference of the container 104, a resin 109 being a neutron absorber is housed between an outer cylinder 108 and the container 104, and cooling fins 110 connecting the container 104 and the outer cylinder 108 are provided. Note that a reference numerical 100 denotes a cushioning body, a reference numeral 101 denotes a cushioning wood, a reference numeral 102 denotes a cushioning can body, and a reference numeral 105 denotes a trunnion.

When the cask basket is formed of the neutron shielding material made of the boron-adding stainless steel that is based on either the two-phase stainless steel or the ferritic stainless steel and is excellent in ductility and thermal conduction property, a function of withstanding a drop impact property and improving cooling performance of loaded spent fuel is obtained.

EXAMPLE

Hereinafter, embodiments of the neutron shielding material will be explained based on examples. First, alloys each made of carbon (C), silicon (Si), manganese (Mn), nickel (Ni), chromium (Cr), boron (B), and iron, and iron were set to be melting raw materials, and in the case of aluminum (Al) being used as an deoxidizer, boron was added in an alloy form with iron, and the melting raw materials were melted. At a steel tapping temperature of about 1500° C., melted alloys were each cast into an ingot case. Here, a homogenized heat treatment (soaking) of ingots was performed. The temperature of the heat treatment was set to 1200° C. Next, immediately before hot forging, the ingots were each heated to about 1100° C., and were each subjected to hot forging in a range of about 900° C. to about 1200° C. to be finished into slabs each having a thickness in a range of 50 to 30 mm. With respect to each of the slabs obtained after the forging, a cutting process was performed on a portion and an end portion corresponding to feeding heads of the ingot in order to roll the slab. Next, in hot rolling, in a range of about 900° C. to about 1200° C., five to six (rolling passes) were performed, (which was set to a pass schedule), and the slabs were each finished to a thickness of about 5 mm or so from a thickness of about 30 mm or so after the rolling. After the rolling, the slabs were each subjected to a heat treatment in a range of 1000 to 1200° C., and were each subjected to a surface treatment to be finished to a product size of 1500 in width×4000 in length×5 mm in thickness, and thereby the neutron shielding materials were obtained.

Chemical components of embodiment materials (based on two-phase stainless steel) being the obtained the neutron shielding materials and a comparative material are shown in Table 1, and properties of the embodiment materials and the comparative material are shown in Table 2. Note that the comparative material is a conventional material manufactured of boron-adding austenitic stainless steel.

TABLE 1

| | Chemical Components (Mass %, Remainder: Fe and Impurities) | | | | | |
|---|---|---|---|---|---|---|
| | C | Si | Mn | Ni | Cr | B |
| Embodiment Material | | | | | | |
| 1 | 0.014 | 0.55 | 1.02 | 7.32 | 25.35 | 1.03 |
| 2 | 0.015 | 0.53 | 0.95 | 7.02 | 25.08 | 1.02 |
| 3 | 0.015 | 0.48 | 1.01 | 8.77 | 25.26 | 1.07 |
| 4 | 0.014 | 0.49 | 1.04 | 6.95 | 25.38 | 1.08 |
| 5 | 0.015 | 0.52 | 1.04 | 5.15 | 25.54 | 1.04 |
| 6 | 0.014 | 0.50 | 1.02 | 6.98 | 27.97 | 1.11 |
| 7 | 0.014 | 0.48 | 1.03 | 5.10 | 28.03 | 1.05 |
| Comparative Material | 0.02 | 0.79 | 0.95 | 10.26 | 19.62 | 1.14 |

TABLE 2

| | Physical Properties | | |
|---|---|---|---|
| Embodiment Material | Ferrite Phase Ratio | Ductility (%) | Thermal Conductivity (W/mK) |
| 1 | 21 | 30.4 | 15.1 |
| 2 | 20 | 29.5 | 14.6 |
| 3 | 8.0 | 31.1 | 14.0 |
| 4 | 22 | 31.3 | 15.6 |
| 5 | 30 | 30.0 | 17.3 |
| 6 | 30 | 29.8 | 17.6 |
| 7 | 31 | 33.3 | 18.1 |
| Comparative Material | 0 | 23.7 | 13.6 |

The ferrite phase ratio is measured based on JIS G 0555. The ductility (elongation) is measured by tensile tests based on JIS Z 2241 (a metal material tensile test method) and JIS G 0567 (a method of elevated temperature tensile test for steels and heat resisting alloys). The measurement of the thermal conductivity is performed by using a laser flush method.

From Table 2, the ferrite phase ratio of embodiment materials 1 to 7 was 8.0 to 31. The ductility (elongation) of the embodiment materials 1 to 7 was 29.5 to 33.3% (temperature 20° C.), and on the other hand, the ductility (elongation) of the comparative material was 23.7% (temperature 20° C.). The thermal conductivity of the embodiment materials 1 to 7 was 14.0 to 18.1 W/mK, and on the other hand, the thermal conductivity of the comparative material was 13.6 W/mK. It was confirmed that the embodiment materials are more excellent in both ductility and thermal conductivity than the comparative material.

Chemical components of embodiment materials being the neutron shielding materials based on ferritic stainless steel obtained similarly by the above-described manufacturing method and the comparative material are shown in Table 3, and properties of the embodiment materials and the comparative material are shown in Table 4.

TABLE 3

| | Chemical Components (Mass %, Remainder: Fe and Impurities) | | | | | |
|---|---|---|---|---|---|---|
| | C | Si | Mn | Ni | Cr | B |
| Embodiment Material | | | | | | |
| 8 | 0.003 | 0.38 | 0.51 | 0.45 | 17.20 | 0.98 |
| 9 | 0.005 | 0.46 | 0.52 | 2.44 | 23.61 | 1.08 |
| 10 | 0.005 | 0.45 | 0.56 | 0.40 | 23.57 | 1.07 |
| 11 | 0.005 | 0.42 | 0.51 | 0.38 | 25.67 | 1.06 |
| 12 | 0.003 | 0.48 | 0.52 | 0.46 | 12.71 | 1.03 |
| Comparative Material | 0.02 | 0.79 | 0.95 | 10.26 | 19.62 | 1.14 |

TABLE 4

| | Physical Properties | |
|---|---|---|
| Embodiment Material | Ductility (%) | Thermal Conductivity (W/mK) |
| 8 | 27.0 | 23.2 |
| 9 | 26.0 | 24.0 |
| 10 | 25.7 | 23.2 |
| 11 | 24.9 | 21.8 |
| 12 | 24.4 | 23.7 |
| Comparative Material | 23.7 | 13.6 |

(As for methods of measuring the ductility and thermal conductivity, see Table 2)

From Table 4, the ductility (elongation) of embodiment materials 8 to 12 was 24.4 to 27.0% (temperature 20° C.), and on the other hand, the ductility (elongation) of the comparative material was 23.7% (temperature 20° C.). The thermal conductivity of the embodiment materials 8 to 12 was 21.8 to 24.0 W/mK, and on the other hand, the thermal conductivity of the comparative material was 13.6 W/mK. It was confirmed that the embodiment materials are more excellent in both ductility and thermal conductivity than the comparative material.

The embodiment material 1 was further measured in terms of an item below. When the chemical components of the embodiment material 1 were analyzed, the chemical components were C: 0.014%, Si: 0.55%, Mn: 1.02%, P: 0.003%, S: 0.001%, Ni: 7.32%, Cr: 25.35%, B: 1.03%, Al: 0.008%, O: 0.0047%, and N: 0.0014%. As a result of measurement of the tip, center, and rear end metal structures in a longitudinal direction of the rolling and hardness of the embodiment material 1, it was confirmed that the neutron shielding material, in which no variations are recognized, boride is uniformly dispersed, and a property of a parent material being the main material is stabilized, is obtained. According to the above manufacturing method, the embodiment material 1 was well manufactured.

Figure 4:
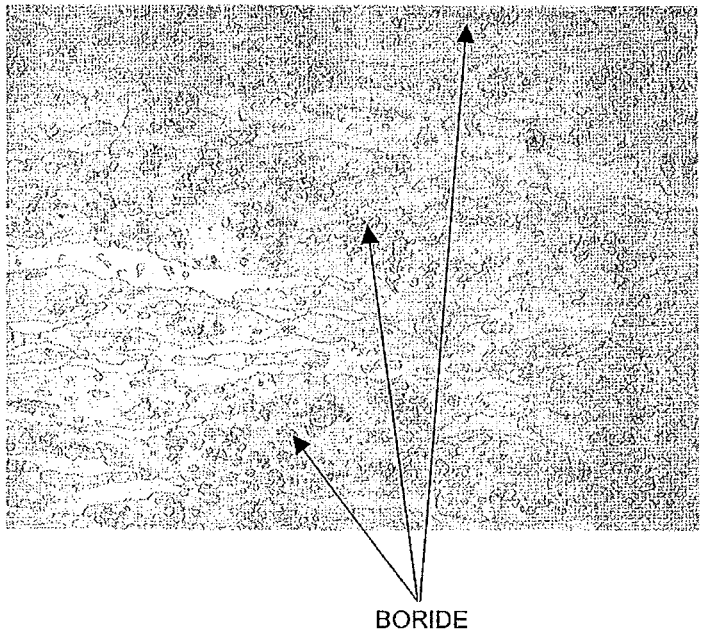
FIG. 4 is a micrograph showing a metal structure of an embodiment.

That is, FIG. 4 is a micrograph showing the metal structure of the embodiment material 1. From FIG. 4, boride uniformly dispersed on the parent material exhibiting the austenite-ferrite composition is confirmed.

Table 5 shows results of the measurement of the hardness of a cross section of the embodiment material 1. In the test, the hardness was measured five times with a test load of 10 kgf by using a Vickers hardness measuring machine. It was confirmed that the hardness of the embodiment material 1 is slightly higher than that of the comparative material, and even after the repeated measurement, the hardness is about HV (Vickers Hardness) 210 or so, resulting in that the structure is stable with small variations.

TABLE 5

| | Vickers Hardness (HV5) | | | | |
|---|---|---|---|---|---|
| | 1st Measurement | 2nd Measurement | 3rd Measurement | 4th Measurement | 5th Measurement |
| Comparative Material | 193 | 189 | 194 | 190 | 198 |
| Embodiment Material 1 | 206 | 212 | 210 | 212 | 213 |

Figure 5:
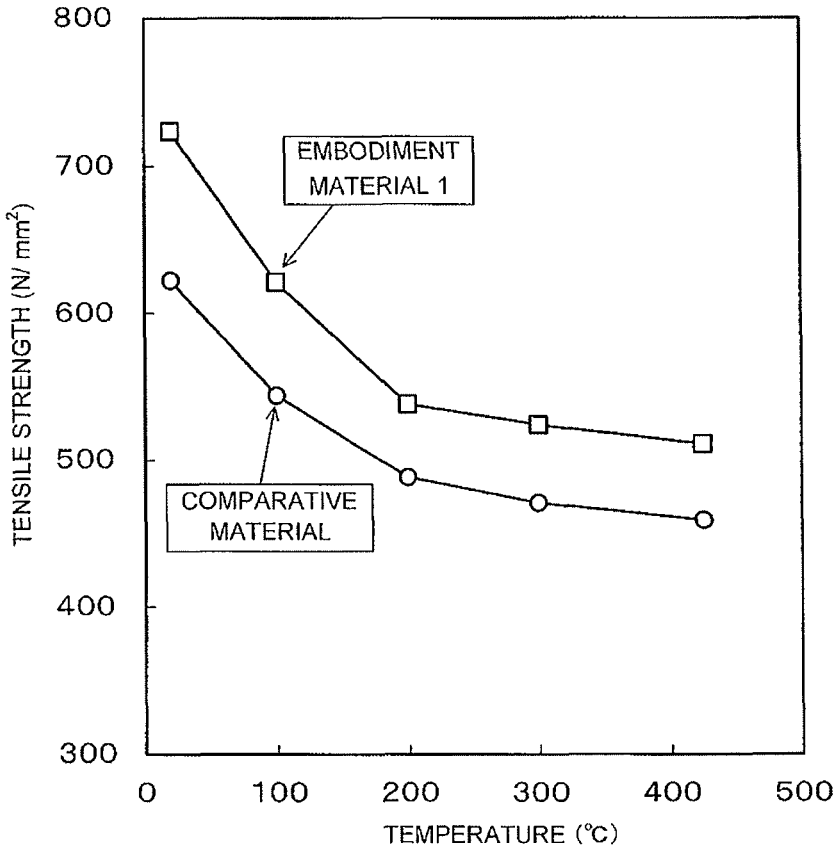
FIG. 5 is a graph showing results of a tensile test (tensile strength).

Further, FIG. 5 is a graph showing results of tensile strength of the embodiment material 1 and the comparative material in a range of normal temperature to 425° C. The tensile strength is measured by tensile tests based on JIS Z 2241 (a metal material tensile test method) and JIS G 0567 (a method of elevated temperature tensile test for steels and heat resisting alloys). In FIG. 5, the vertical axis indicates tensile strength (N/mm2), and the horizontal axis indicates temperature (° C.), and it was confirmed that the embodiment material 1 is higher in strength than the comparative material and is the shielding material exhibiting excellent strength.

Figure 6:
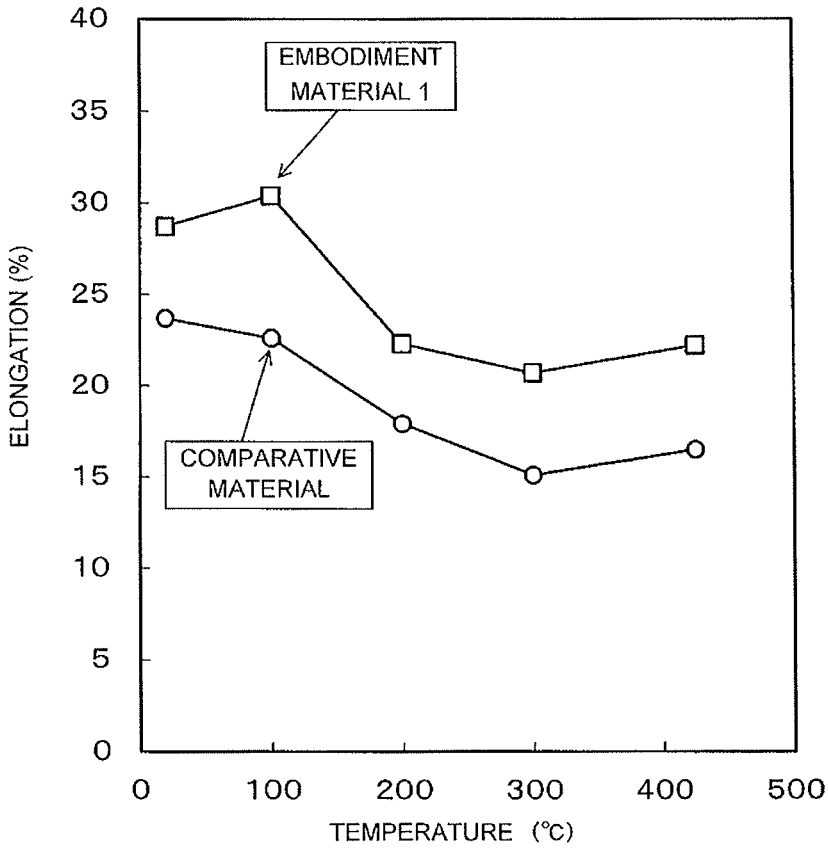
FIG. 6 is a graph showing results of a tensile test (elongation).

When the inevitable impurities are controlled to fall within the specific range, the neutron shielding material made of the boron-adding stainless steel having high ductility in the above-described embodiment is obtained. In order to prove the above fact, the ductility (elongation) in a range of normal temperature to 425° C. was compared between the embodiment material 1 and the comparative material. FIG. 6 is a graph showing the ductility (elongation) of the embodiment material 1 and the comparative material in a range of normal temperature to 425° C. (see the test methods in FIG. 5). In FIG. 6, the vertical axis indicates elongation (%), and the horizontal axis indicates temperature (° C.), and it was confirmed that the embodiment material 1 is higher in ductility than the comparative material in the entire temperature range and exhibits excellent ductility.

Figure 7:
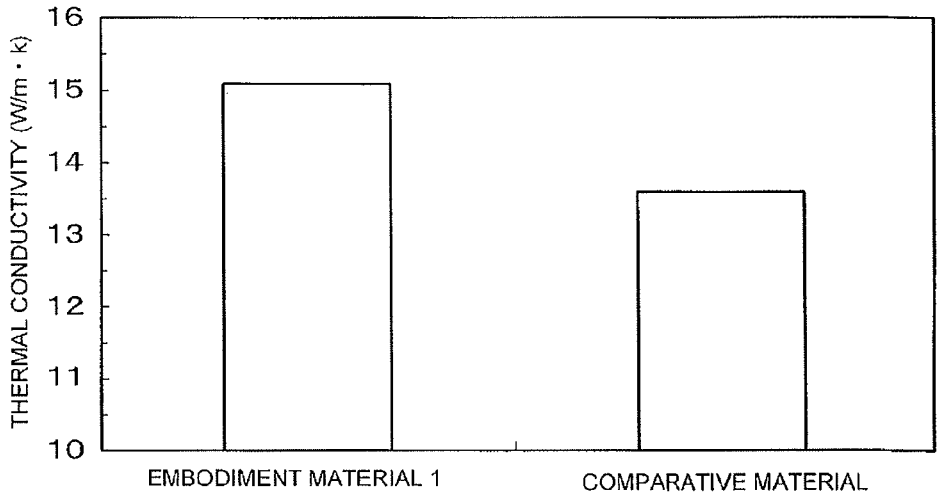
FIG. 7 is a graph showing measurement results of thermal conductivity.

FIG. 7 is a graph showing comparison of thermal conductivity measurement results between the embodiment material 1 and the comparative material. In FIG. 7, the vertical axis indicates thermal conductivity (W/m·K), and it was found that the thermal conductivity of the embodiment material 1 is about 15.1 W/m·K, and is improved more than that of the comparative material, which is 13.6 W/m·K.

Figure 8:
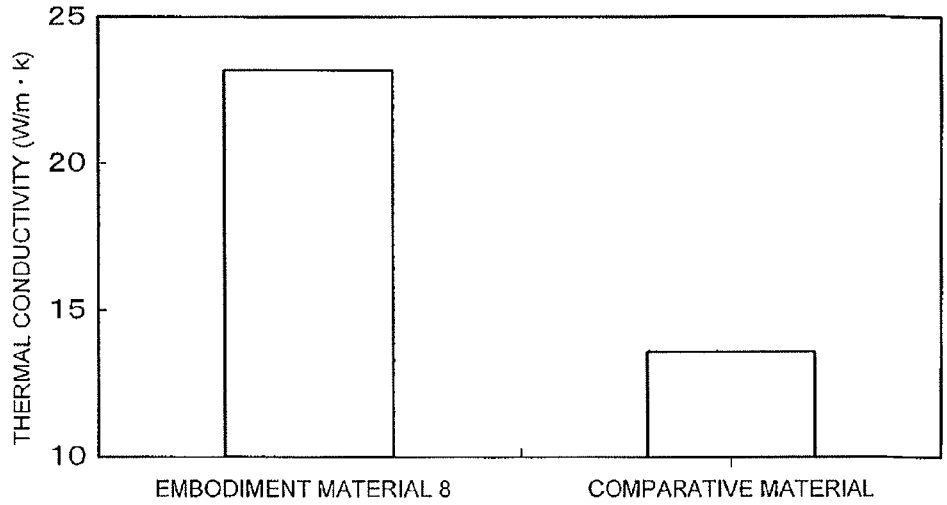
FIG. 8 is another graph showing measurement results of thermal conductivity.

FIG. 8 is a graph showing comparison of thermal conductivity measurement results between the embodiment material 8 and the comparative material. When the chemical components of the embodiment material 8 were analyzed, the chemical components were C: 0.003%, Si: 0.38%, Mn: 0.51%, P: 0.003%, S: 0.001%, Ni: 0.45%, Cr: 17%, B: 0.98%, Al: 0.006%, O: 0.0037%, and N: 0.0020%. In FIG. 8, the vertical axis indicates thermal conductivity (W/m·K), and it was found that the thermal conductivity of the embodiment material 8 is about 23.2 W/m·K, and is improved more than that of the comparative material, which is 13.6 W/m·K.

According to the above-described embodiments and examples, effects as described below are obtained.

(1) By employing the embodiment materials, the neutron shielding material exhibiting strength higher than that of the comparative material and capable of withstanding transport and the like as the basket material is obtained.

(2) By employing the embodiment materials, the neutron shielding material that exhibits ductility higher than that of the comparative material and does not easily break even when impact and the like are applied to fuel is obtained.

(3) By employing the embodiment materials, the thermal conduction property higher than that of the comparative material can be exhibited and efficient cooling of spent fuel is made possible, thereby leading to performance improvement of the metal cask container by increase in density and increase in capacity of fuel storage.

(4) By employing the embodiment materials, the embodiment materials can be manufactured similarly to the comparative material, and further development of the boron-adding alloy in which an added amount of Ni is suppressed lower than that of the comparative material is made possible, thereby allowing a significant reduction in material cost to be achieved.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A cask for spent fuel, comprising:

a cylindrical container;

a lattice-shaped basket that is housed in the container and is for housing spent fuel therein;

a lid for sealing the container;

an outer cylinder covering the entire container;

a resin for absorbing neutrons that is housed between the container and the outer cylinder;

cooling fins provided in the resin in order to connect the container and the outer cylinder; and the basket being manufactured of a neutron shielding material made of boron-adding stainless steel of austenite-ferrite two-phase stainless steel or ferritic stainless steel, the austenite-ferrite two-phase stainless steel containing, in mass %, B: 0.5% to 2.0%, Ni: 3.0 to 10.0%, and Cr: 21.00 to 32.00%, the ferritic stainless steel containing, in mass %, B: 0.5% to 2.0%, Ni: 4.0% or less, and Cr: 11.00 to 32.00%, and the boron-adding stainless steel being well in ductility and thermal conduction property.

2. The cask for spent fuel according to claim 1, wherein either the austenite-ferrite two-phase stainless steel or the ferritic stainless steel contains, in mass %, P: 0.010% or less, S: 0.002% or less, Al: 0.05% or less, O: 0.008% or less, and N: 0.005% or less as inevitable impurities.

3. The cask for spent fuel according to claim 1, wherein either the austenite-ferrite two-phase stainless steel or the ferritic stainless steel contains, in mass %, C: 0.030% or less, Si: 1.00% or less, Mn: 1.50% or less, and Mo: 3.50% or less.

4. The cask for spent fuel according to claim 2, wherein either the austenite-ferrite two-phase stainless steel or the ferritic stainless steel contains, in mass %, C: 0.030% or less, Si: 1.00% or less, Mn: 1.50% or less, and Mo: 3.50% or less.

5. The cask for spent fuel according to claim 1, wherein a ferrite phase ratio of the austenite-ferrite two-phase stainless steel is within a range of 7 to 98%.

* * * * *